United States Patent [19]

Hull

[11] Patent Number: 4,978,119

[45] Date of Patent: Dec. 18, 1990

[54] EXERCISING DEVICE FOR SIMULATING ATHLETIC MOVEMENTS

[76] Inventor: Martin P. Hull, 800 Bear Culch Rd., Woodside, Calif. 94062

[21] Appl. No.: 428,114

[22] Filed: Oct. 27, 1989

[51] Int. Cl.[5] ..... A63B 31/00; A63B 21/062

[52] U.S. Cl. ..... 272/71; 272/118

[58] Field of Search ..... 272/71, 72, 117, 118, 272/132, 134, 136, 142, 143, DIG. 4

[56] References Cited

U.S. PATENT DOCUMENTS

| | | | |
|---|---|---|---|
| 684,688 | 10/1901 | Herz | 272/117 |
| 3,806,121 | 4/1974 | Crossley | 272/67 X |
| 3,982,755 | 9/1976 | Sarich | 272/117 |
| 4,511,137 | 4/1985 | Jones | 272/118 |
| 4,603,855 | 8/1986 | Sebelle | 272/117 |
| 4,709,920 | 12/1987 | Schnell | 272/117 |
| 4,846,460 | 7/1989 | Duke | 272/72 |

FOREIGN PATENT DOCUMENTS

| | | | |
|---|---|---|---|
| 611623 | 6/1978 | U.S.S.R. | 272/117 |
| 347533 | 4/1931 | United Kingdom | 272/72 |

*Primary Examiner*—Robert W. Bahr

*Attorney, Agent, or Firm*—Douglas A. Chaikin

[57] ABSTRACT

Disclosed herein is an exercising device for simulating athletic movements. The device includes a frame, having an upper end and a lower end and the lower end having a base. A pulley assembly is rotatably connected to the frame. The pulley assembly includes a pulley and a spool having two stages. The first stage of the spool is positioned closest to the pulley and has a gradually increasing outside diameter as the distance from the pulley increases defining an incline for self-tending. The second stage defines a step function decrease in the mechanical advantage of the pulley assembly, and also includes an increading outside diameter as the distance from the pulley increases, also for self-tending. The exercising device further includes a pull/resistance structure for rotating the pulley and spool together connected to the frame.

15 Claims, 3 Drawing Sheets

EXERCISING DEVICE FOR SIMULATING ATHLETIC MOVEMENTS

BACKGROUND OF THE INVENTION

FIELD OF THE INVENTION

This invention relates to exercising devices, and more particularly, exercising devices which are designed to specifically simulate athletic movements.

During the past twenty-five years, exercising devices have become popular. Various types of exercising devices for strengthening and conditioning and toning muscles have become widely known. Such devices include those made by Nautilus and Universal which are designed to specifically condition and strengthen a certain group of muscles or an individual muscle, e.g. biceps and triceps.

There have also been devices which are designed to enhance and simulate specific athletic movement. These devices include exercising bicycles and rowing apparatus. However, these types of devices are designed to strengthen and condition muscles. These devices do not aide the user in the neuromuscular coordination necessary for his athletic movements. For example, a world class bicyclist does not train on an exercise bicycle to improve his neuromuscular co-ordination. Nor does a world class rower use a rowing machine for that purpose. Each of these devices lacks the ability to vary the resistance of the device during the particular exercise. Thus, while there have been devices for strengthening and conditioning muscles, there is no device which accurately simulates the specific athletic movement such that the neuromuscular coordination is improved.

What is needed is an exercising device which can be easily modified so that it may be adapted for various athletic movements. For example, the arm stroke in swimming in the Australian Crawl is slow at first, then the hand gradually increases in speed as it is moved posteriorly and, as it does so, the force exerted by the swimmer increases, as does his speed. Finally, the hand movements completed and the swimmer uses his other hand to begin the next stroke of the crawl. The invention herein is designed to simulate such swimming movements and be adaptable to be easily changed from simulating one type of athletic movement to another.

SUMMARY OF THE INVENTION

It is a general object of this invention to provide an exercising device which simulates specific athletic movements.

It is a further object of this invention to provide an exercising device which can be easily modified to simulate a variety of different athletic movements.

It is a further object of this invention to provide an exercising device which allows a swimmer to condition and train arm stroke movements.

In accordance with the above objects in the invention and in order to achieve the advantages, as will be described more fully hereinafter, this invention comprises:

- a frame having an upper end and a lower end and the lower end including a base;
- a pulley assembly rotatably connected to the frame, the pulley assembly including:
  - a pulley and a two-stage spool, the spool having a first stage having a substantially greater mechanical advantage than the pulley alone and a second stage having a step function smaller mechanical advantage than the mechanical advantage of the first stage of the spool and the pulley, and
  - pull/resistance means connected to the pulley and spool for rotating the pulley and the spool.

The invention accomplishes the simulation of various athletic movements by varying the mechanical advantage of the exercising device in accordance with this invention. As used herein mechanical advantage means the ratio of force produced by the exercising device to the force applied to it. This is also know as the force ratio.

In a preferred embodiment of the invention, the invention includes a pair of pulley means, one right-handed and one lefthanded, mounted rotatably on the frame on an axle. The pulley means operates independently and can be used simultaneously or singly. In this side-by-side embodiment, the pulleys operate virtually identically and are in a mirror image relationship to one another.

In an additional preferred embodiment, the spool of the pulley assembly is self-tending.

Additional preferred embodiments include the pulley and spool as a one piece assembly, with the pulley being a single groove pulley and functioning as a guide for the pull/resistance structure. Also, preferred embodiments include the pull/resistance structure as including a rope and having a handle at one end and a weight stack at the other.

In still another preferred embodiment, the pulley and spool are of sufficient size and there is sufficient length to the rope to allow at least a six (6) down stroke. It will be appreciated more fully hereinafter that the resistance during the down stroke that the resistance to move the weight is constantly increasing, such that at the end of the down stroke, including a six (6) down stroke, the resistance to movement of the weight is at its peak.

It is an advantage of this invention to allow a user to simulate various athletic movements for strengthening and conditioning, as well as increasing neuromuscular coordination.

It is a further object of this invention that a swimmer can improve his speed and stamina by training on the exercising device as a result of increased strength and neuromuscular coordination.

It is a further advantage of this invention to be able to train for a particular athletic event using the instant invention.

The invention will now be described more fully with respect to the drawing, as set forth below.

DETAILED DESCRIPTION OF THE INVENTION

Figure 1:
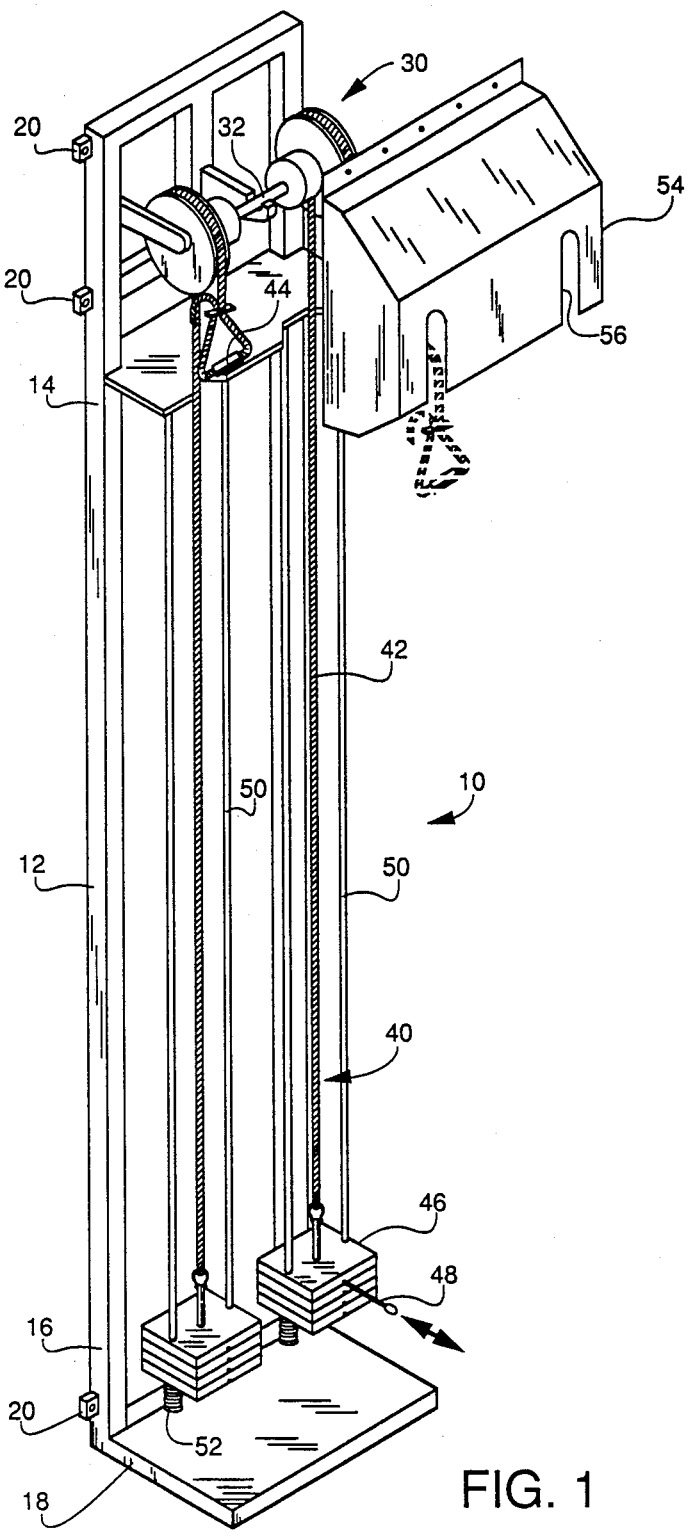
FIG. 1 is a side perspective view of the exercising device for simulating athletic movements in accordance with this invention.

The invention will now be described with reference to the figures in which like-referenced characters designate like or corresponding parts throughout several views and referring particularly to FIG. 1, there is shown a side-by-side embodiment of the invention, an exercising device for simulating athletic movements, generally designated by the numeral 10. The exercising device 10 includes a frame 12 having an upper end 14 and a lower end 16. The lower end 16 includes a base 18. The embodiment 10 shown in FIG. 1 is designed specifically for mounting the exercising device 10 on a wall (not shown). It will be noted that the frame 12 includes tabs 20 which extend from the frame 14 and which have openings so that screws or other mounting apparatus may be placed therethrough and inserted into a wall for mounting of the device 10. It will also be appreciated that the frame 12 may include diagonal bracing (not shown) for a free-standing embodiment. The frame 12 shown in FIG. 1 is 7'6" in height and is made from 1½ inch square tube steel.

Figure 2:
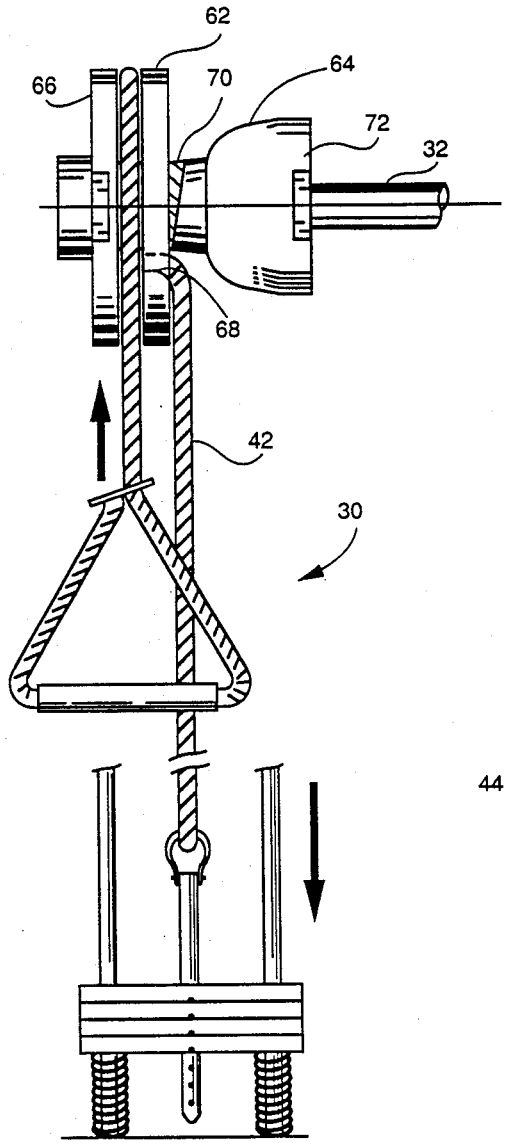
FIGS. 2 and 3 are partial front sectional views illustrating the pulley assembly and its operation.
Figure 3:
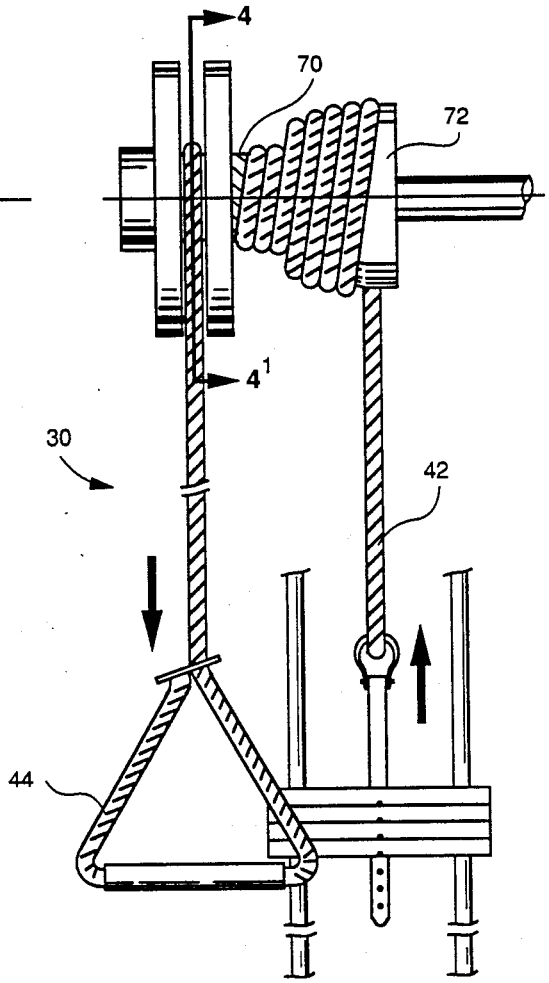

The exercising device 10 also includes a pulley assembly generally designated by the numeral 30. The operation of the pulley assembly 30 is best shown in FIGS. 2 and 3. The pulley assembly 30 shown in FIG. 1 is a side-by-side pulley assembly embodiment. It will be appreciated that a single pulley assembly embodiment is also within the spirit and scope of this invention.

Each pulley assembly 32 includes a pulley 62 which is mounted rotatably on the frame 12 by an axle 32 and the movement of each is independent of the other. There is a lefthanded and righthanded pulley assembly mounted on the frame 12 in mirror image relation as shown in FIG. 1.

The exercising device 10 also includes a pull/resistance apparatus generally designated by the numeral 40. The pull/ resistance apparatus includes a rope 42. At one end of the rope 42 there is a handle 44 suitable for pulling the rope 42. On the other end of the rope 42 is a stack of weights 46 comprising the resistance part of the pull/resistance apparatus 40. The weight stack 46 can be varied by placing a selecting rod 48 in the openings between the weights 46 as is well known in the art.

The weights are pulled up by exerting force on the handles 44. As the weights 46 move upward they are guided by guide rods 50. Between the base 18 and the weights 46 each of the guide rods 50 includes a spring 52 to support the weights 46 above the base 18 as is well known in the art.

The exercising device further includes a cover 54. The cover 54 is attached to the upper end 14 of the frame 12. The cover 54 protects the operative part of the device 10 by keeping dust and lint away from the working surfaces of the axle 32 and frame 12. The cover 54 includes longitudinal slots 56 which provide space for the pull/resistance apparatus 40 to be operated freely and without interference from the cover 54.

With particular reference to FIGS. 2 and 3, there is shown a detailed view of the pulley assembly 30. It will be appreciated that while only the lefthanded pulley assembly is shown and that the righthanded pulley assembly works in precisely the same way. The pulley assembly 30 includes a pulley 62 and a two-stage spool 64. The spool 64 and the pulley 62 rotate together on axle 32 as the pull/resistance apparatus 40 is operated. In the preferred embodiment, the pulley 62 and spool 64 are a one-piece assembly.

Figure 4:
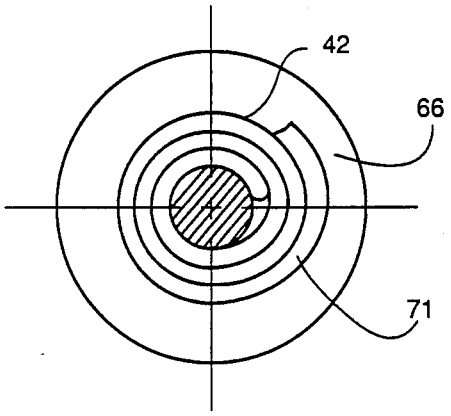
FIG. 4 is a cross-sectional view of a pulley in the pulley assembly taken along lines 4—4 of FIG. 3 in the direction of the arrows.

The pulley 62 is a single groove pulley having extended ears 66 as best shown in FIG. 4. The extended ears 66 allow the rope 42 to be guided and have multiple rope windings, as shown in FIG. 4. Additionally, the pulley 62 includes an opening 68 eccentrically placed, to allow the rope 42 to be threaded onto the spool 64 as best shown in FIG. 2.

The mechanical advantage of the pulley assembly 30 varies depending upon the position of the device 10 in use. For example, when an exercise using the device 10 is about to be initiated, the rope 42 is fully wound around the pulley 62 and the mechanical advantage is greater than when the pulley 62 is emptied of rope 42 (when the down stroke of the exercise is completed). In the preferred embodiment the maximum length of the stroke is 6 feet.

The spool 64 includes a first stage 70 being capable of having multiple windings of rope 42. It will be appreciated that the rope 42 winds the spool 64 on the down stroke so that the diameter of the spool 64 is inversely proportional to the mechanical advantage of the device 10. During that portion of the down stroke where the rope is being wound along the first stage 70 of the spool 64, the mechanical advantage peaks. This is especially so at the very beginning of the initial phase when there are still multiple windings of rope 42 on the pulley 62. The mechanical advantage of the device 10 is the greatest at the beginning of the exercise because both the pulley 62 and the spool 64 each have their greatest mechanical advantage during that phase of the exercise.

The spool 64, when taken in its entirety, is self-tending, meaning that it does not require additional structure of any kind for the threading of the rope 42 onto the pulley 62. In order to accomplish the self-tending function of the spool 64, the outside diameter of the first stage 70 gradually increases as the distance from the ear 66 of the pulley 62 increases. This increase in the outside diameter causes the wrapping of the spool 64 to be tight and in a single winding.

The spool 64 has a second stage 72 which has a step function increase in the size of the outside diameter upon which the rope 42 is wound. This step function increase in diameter is a step function decrease in mechanical advantage relative to the first stage 70, since the spool 64 is wound on the down stroke the diameter is inversely proportional to the mechanical advantage.

As illustrated in FIG. 3, as the handle 44 is pulled downward during the down stroke, the rope 42 wraps around the first stage 70 and then around the second stage 72 of the spool 64. As the rope 42 wraps around the second stage 72, the user loses a significant mechanical advantage (a step function mechanical advantage) compared to the first stage 70 because the size of the diameter of the spool 64 is inversely proportional to the mechanical advantage of the device 10.

The second stage 72 is similarly self-tending. The second stage 72 is also inclined and has an increasing outside diameter as the distance from the ear 66 of the pulley 62 increases. In the preferred embodiment shown in the FIGS. 1–4, the outside diameter of the second stage 72 remains constant at an end zone 74 so that no further mechanical advantage is lost at the end zone 74. However, the second stage 72 retains its self-tending capability throughout.

IN OPERATION

In operation, the exercising device 10 simulates a swimming stroke. It will be appreciated that during the initial part of a swimming stroke, the force required to start the hand moving backward is quite low. In fact the swimmer must exert the proper amount of force during this portion of the stroke in order to keep the body within the water line. If a swimmer were to exert too high a force during this initial phase, he could "pop up" out of the water and lose efficiency as will be explained more fully below. The exercising device 10 similarly requires the least amount of force to move the weights 46 in the initial phase of the exercise, i.e. when the device 10 has its greatest mechanical advantage as explained in detail above.

Toward the middle of the swimming stroke the user must exert greater and greater force to keep propelling himself forward. As the hand moves to a position directly below the swimmer it can no longer generate much upward force. Thus, if the swimmer were pushed up too high during the initial phase of the stroke, for example if too much force had been exerted during the initial phase, he would "come crashing down" into the water in the middle of the stroke. This would cause increase in drag on the body and lower the swimmer's speed. In fact, the entire stroke would be inefficient and undesirable because the swimmer would be constantly accelerating and then decelerating with the need to re-accelerate to get back to the original speed.

During the middle portion of the stroke, it is ideal for the swimmer to maintain a constantly increasing arm force to keep his pace. In order to do this, the swimmer must exerting a constantly and gradually increasing arm force after the initial phase. The exercising device 10 simulates this portion of the swimming stroke as the rope 42 is wound around the second stage 72 of the spool 64. The mechanical advantage decreases by a step function as set forth above and the user must apply constantly increasing force because the pulley 62 loses its mechanical advantage as the windings of the rope 42 are unwound from the pulley 62. At the end of the down stroke, the pulley 62 is emptied of its rope windings and the second stage 72 is fully wound. Thus, the force needed to move the weights 46 is at its greatest at the end of the downstroke which precisely simulates the desired swimming stroke.

Thus, the invention shown and described herein simulates the athletic movement of a swimming stroke as well as other similar athletic movements. Various adjustments and modifications may be made to the apparatus and particularly the pulley assembly so that other athletic movements could simulated within the spirit and scope of this invention. Those modifications are within the spirit and scope of this invention. This invention is not to be limited except as set forth in the claims below.

What is claimed is:

1. An exercising device for simulating athletic movements, the device comprising:

a frame having an upper end and a lower end and the lower end including a base;

a pulley assembly rotatably connected to the frame, the pulley assembly including:

a pulley and a two-stage spool, the spool having a first stage having a substantially greater mechanical advantage than the pulley alone and a second stage having a step function smaller mechanical advantage than the mechanical advantage of the first stage of the spool and the pulley, a pull/resistance means connected to the pulley and spool for rotating the pulley and spool.

2. A device as set forth in claim 1 wherein the spool is self-tending.

3. A device as set forth in claim 2 wherein the spool has a smooth outside surface.

4. An exercising device for simulating a sports movement, particularly a swimming stroke, the device comprising:

a frame having an upper end and a lower end and including a base; and a pulley assembly rotatably connected to the frame, the pulley assembly including a pulley and a spool having two stages, the first stage of the spool positioned closest to the pulley having a gradually increasing outside diameter as the distance from the pulley increases, the second stage of the spool having a step function increase in outside diameter, the second stage defining a step function decrease in mechanical advantage of the pulley assembly, the pulley further including a pull/resistance means for rotating the pulley and spool together, the pull/resistance connected to the pulley assembly.

5. A device as set forth in claim 4 wherein the pulley and spool are a one piece assembly.

6. A device as set forth in claim 4 wherein the pulley defines a single groove pulley and functions as a guide means for the pull/resistance means.

7. A device as set forth in claim 6 wherein the pull/resistance means comprises a rope threaded onto the pulley and capable of being threaded onto the spool and wherein at one end of the rope there is a handle and at the other end there is a stack of weights.

8. A device as set forth in claim 4 wherein the pulley and spool are rotatable on the frame by means of an axle threaded through each of the centers of the pulley and spool.

9. A device as set forth in claim 4 wherein the spool is located on one side of the pulley and there is an opening in the pulley on the spool side for connection with the pull/resistance means.

10. An exercising device as set forth in claim 4, wherein the pulley and spool are sized so that the maximum length of a down stroke is at least sox (6) feet.

11. An exercising device for simulating a sports movement, particularly a swimming stroke, the device comprising:

a frame having an upper end and a lower end and including a base; and a pulley assembly rotatably connected to the frame, the pulley assembly including a pulley and a spool having two stages, the pulley defining a single groove pulley, the first stage of the spool positioned closest to the pulley having a gradually increasing outside diameter as the distance from the pulley increases, the second stage of the spool having a step function increase in outside diameter, the second stage defining a step function decrease in mechanical advantage of the pulley assembly, the pulley additionally including a pull/resistance means for rotating the pulley and spool together, the pull/resistance means comprising a rope threaded onto the pulley and capable of being threaded onto the pool, one end of the rope having a handle and the other end of the rope having a stack of weights, the rope connected to the pulley assembly and the pulley defining a guide for the rope and the pulley being one rope width wide.

12. An exercising device for simulating swim strokes, comprising:

a frame having an upper end and a lower end, the lower end having a base;

a pulley assembly rotatably connected to the frame, the pulley assembly including a pair of one piece pulley and spools mounted in side by side relation on the frame, each of the spools defining a two-stage threading portion, the first stage of the threading portion having a significantly greater mechanical advantage than the pulley, the first stage located adjacent to the pulley and the second stage being located adjacent to the first stage and having a step function decrease mechanical advantage than the first stage, each stage having a generally increasing outside diameter as the distance from the pulley increases, defining self-tending means, the pulley assembly further including a rope threaded onto the pulley and spool with a handle for pulling on one end and a means for resistance pull by the handle on the other end, the rope being threaded onto the handle and spool such that when the handle is pulled the spool and pulley rotate against the resistance means.

13. An exercising device as set forth in claim 12, wherein each of the pulleys define single groove pulleys having extended ears which define guides for the rope.

14. An exercising device as set forth in claim 13, wherein each of the pulleys is capable of having multiple windings of the rope to increase and vary the mechanical advantage of the pulley.

15. An exercising device as set forth in claim 14, wherein each of the pulley and spools operate independently.

* * * * *